United States Patent [19]

MacDougall

[11] Patent Number: 5,036,478

[45] Date of Patent: Jul. 30, 1991

[54] COMPUTING THE LENGTH OF A RAILWAY VEHICLE OR A TRAIN OF SUCH VEHICLES

[75] Inventor: David B. MacDougall, Chippenham, United Kingdom

[73] Assignee: Westinghouse Brake and Signal Holdings Limited, Chippenham, United Kingdom

[21] Appl. No.: 337,503

[22] Filed: Apr. 13, 1989

[30] Foreign Application Priority Data

May 9, 1988 [GB] United Kingdom ..... 8810922

[51] Int. Cl.[5] ..... B61L 23/34; G06F 15/48

[52] U.S. Cl. ..... 364/562; 364/436; 340/901; 246/122 R; 246/247

[58] Field of Search ..... 364/562, 560, 550, 551.01, 364/424.01, 426.05, 436, 138; 246/1 R, 3, 5, 122 R, 167 R, 187 B, 122 A, 124, 167 D, 247, 249; 340/901

[56] References Cited

U.S. PATENT DOCUMENTS

| | | | |
|---|---|---|---|
| 3,556,236 | 1/1971 | Cory et al. | 246/247 X |
| 3,888,437 | 6/1975 | Birkin | 246/122 R X |
| 3,902,689 | 9/1975 | Hermann et al. | 246/122 R X |
| 4,023,753 | 5/1977 | Dobler | 364/436 X |
| 4,128,218 | 12/1978 | Pohlig | 246/247 |
| 4,247,768 | 1/1981 | Elmer et al. | 364/562 X |
| 4,247,897 | 1/1981 | McDonald et al. | 364/424.01 |
| 4,361,301 | 11/1982 | Rush | 364/436 X |
| 4,711,418 | 12/1987 | Aver, Jr. et al. | 246/187 B X |
| 4,735,383 | 4/1988 | Corrie | 246/3 |
| 4,791,571 | 12/1988 | Takahashi et al. | 364/436 |

FOREIGN PATENT DOCUMENTS

| | | | |
|---|---|---|---|
| 1228655 | 11/1966 | Fed. Rep. of Germany . | |
| 1232610 | 1/1967 | Fed. Rep. of Germany . | |
| 1233004 | 1/1967 | Fed. Rep. of Germany . | |
| 2053280 | 5/1972 | Fed. Rep. of Germany . | |
| 2655921 | 5/1978 | Fed. Rep. of Germany | 364/562 |
| 3300429 | 7/1984 | Fed. Rep. of Germany | 246/247 |
| 3445115 | 6/1986 | Fed. Rep. of Germany | 246/247 |
| 1027507 | 4/1966 | United Kingdom . | |

*Primary Examiner*—Joseph L. Dixon

*Attorney, Agent, or Firm*—Nilsson, Robbins, Dalgarn, Berliner, Carson & Wurst

[57] ABSTRACT

In a railway signalling system, the length of a vehicle or train is computed by on board measurement of the distance travelled between detecting the passage of the front of the vehicle or train past a fixed point and detecting the passage of the rear of the vehicle or train past the same fixed point or a fixed point a known distance from the first.

9 Claims, 1 Drawing Sheet

COMPUTING THE LENGTH OF A RAILWAY VEHICLE OR A TRAIN OF SUCH VEHICLES

BACKGROUND OF THE INVENTION

The present invention relates to computing the length of a railway vehicle or a train of such vehicles.

The concept of replacing conventional railway signalling equipment by train carried, point controlling, and interlocking modules inter-connected by radio or other transmission medium is well known. There are however certain practical difficulties, missing elements, and unnecessary complications in the realization of known systems. One such is the method of determining the location of the tail (or rear) of a train for the purposes of authorizing a following train to proceed or of allowing a route which has been traversed to be released.

In some known systems, train location is determined by an on-board train computer by a combination of reference wayside markers such as transponders, loop ends, loop transpositions or the like together with on-board distance measurement derived from an odometer, tachometer or equivalent device such as a reader of closely spaced track-side marks, plates or loop transpositions or the like. The location thus derived is reported to a wayside control computer which uses the information as the basis for generating movement authorities for transmission to trains with reference also to supervisory controls and fixed interlocking data. For the purpose of route release behind a train and to define the limit of proceed authority for a following train it is necessary for the control computer to deduce the location of the rear of the train. In a known system (British Patent Specification No. 2 189 066)/the control computer does this by reference to the "train consist" (i.e. the overall composition of the train) from which train length can be derived. In practice there are difficulties in ensuring that such information is in a sufficiently vital form for use in safety functions. It would be possible to provide equipment at the rear of the train equivalent to that at the front and to report the location of the rear of the train separately from the front, but this would be complicated and expensive and would double the number of mobile identities to be serviced by the communications system. It is also frequently impractical to locate appropriate equipment at the rear of a train.

SUMMARY OF THE INVENTION

According to the present invention, there is provided a railway signalling system including a railway vehicle or a train of such vehicles, in which system, for computing the length of the railway vehicle or train, an on board measurement takes place of the distance travelled between detecting the passage of the front of the vehicle or train past a fixed point and detecting the passage of the rear of the vehicle or train past the same fixed point or a fixed point a known distance from the first.

Vehicle or train length may be measured by a vehicle or train computer in conjunction with other devices and this measurement will be used by the vehicle or train computer to deduce and report the location of the tail (or rear) of the vehicle or train to a control computer or directly to a following vehicle or train, or alternatively the vehicle or train computer will send the vehicle or train length to the control computer which will subsequently use it to deduce the location of the vehicle or train tail from reports of the location of the vehicle or train head (or front) sent by the vehicle or train computer The present invention enables a system whereby a railway vehicle or train of such vehicles can measure its own length and use this information to deduce and report to a following vehicle or train, or to an interlocking or control computer, or both, the location or clearance of its tail in relation to fixed points along the track or to pass a positive report of vehicle or train length to an interlocking or control computer to enable the interlocking or control computer to effect subsequent route release and give proceed authorities to following vehicles or trains based on reports from the vehicle or train of the location of its front only.

Vehicle or train length need be measured only at locations where trains may divide or vehicles attach or where journeys commence.

BRIEF DESCRIPTION OF THE DRAWINGS

The present invention will now be described, by way of example, with reference to the accompanying drawings, in which.

DETAILED DESCRIPTION

Figure 1A:
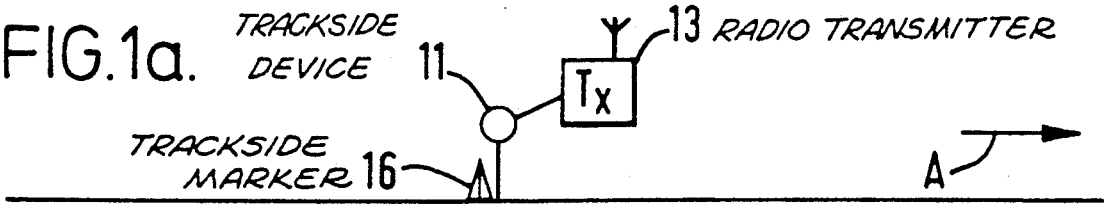
FIG. 1*a*) shows schematically an active trackside device.
Figure 1B:
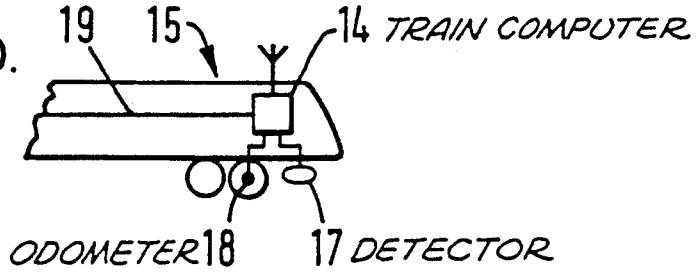
FIGS. 1*b*) and 1*c*) show respectively the front and rear of a train passing the device of FIG. 1*a*)
Figure 1C:
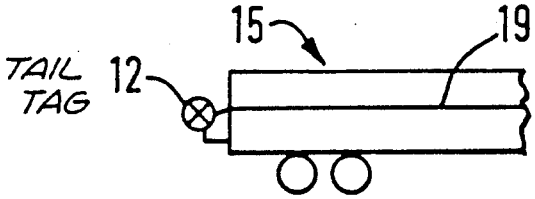

Referring first to FIGS. 1*a*), 1*b*) and 1*c*), a trackside device 11 such as a transponder reader or magnet detector detects a corresponding tail tag 12 mounted on the tail of a train 15 moving in the direction of arrow A and generates a train tail detection message which is transmitted by a radio transmitter 13 to a train computer 14 at the front of the train 15. The location of the trackside device 11 is first recorded by the train computer as the front of the train passes and detects either a related trackside marker 16 (such as a transponder) or the active trackside device 11 itself by means of a detector 17, which may be a transponder reader of known type also used for other signalling purposes. The train computer 14 tracks distance travelled as in known systems, for example by an odometer 18, and is therefore able to measure the distance travelled between detection of the trackside device 11 or its associated marker 16 and receipt of the train tail detection message from the trackside device 11. This distance corresponds to the train length. Any error arising from delays in transmission of the tail detection message will result in excessive train length being measured, which is a safe error. Whether the measured train length is used by the train computer 14 to report tail location, or is transmitted by the train computer 14 to a wayside or centrally located control computer to enable it to deduce train tail location from train head location reports, some form of continuous monitoring is required to ensure that the train is complete, which for example may be continuous detection of a rear of train loop device via a train line 19 or may be continuous reception of a signal transmitted by radio or other means from a rear of train transmitter. Loss of monitoring will cause the train computer 14 to cease or modify train location reports so as to ensure that any detached train portion is protected by the signalling system. If a maximum train length can be defined, the system can be arranged to use this as a default value in the event of failure of the measuring function, thus enabling the rest of the signalling system to continue operation, albeit in a degraded mode. If the marker 16 is used, to be detected by detector 17, then the device 11 detected by tail tag 12 may be at a fixed point a known distance from marker 16.

Figure 2A:
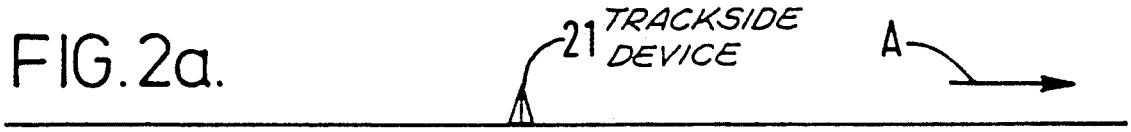
FIG. 2*a*) shows schematically a passive trackside device.
Figure 2B:
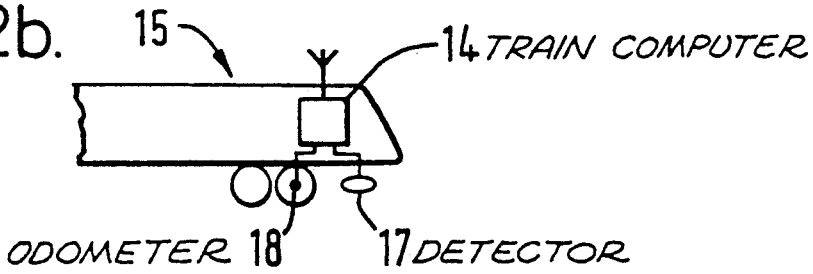
FIGS. 2*b*) and 2*c*) show respectively the front and rear of a train passing the device of FIG. 2*a*).
Figure 2C:
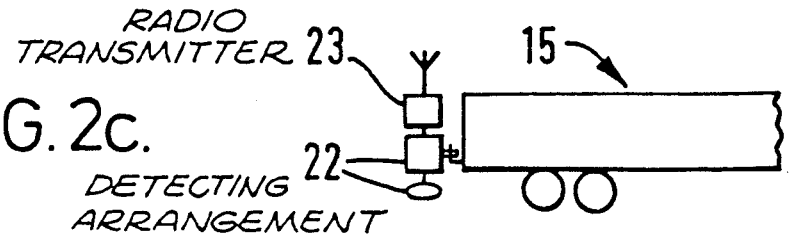

Referring to FIGS. 2*a*), 2*b*) and 2*c*), in a second example, a passive trackside device 21 such as a transponder or magnet is detected by an active train tail mounted detecting arrangement 22 which generates a detection message which is transmitted by an associated radio transmitter 23 or train line or other medium to the train computer 14 at the front of the train. The location of the trackside device or a similar associated device, will first be recorded by the train computer when the front of the train passes it in a similar manner to the first example. Computation and subsequent application of train length information will be generally similar to the first example. Continuous detection of train rear may also be performed by part of the equipment which forms the active train tail mounted arrangement. The train tail mounted arrangement could detect a separate passive device at a fixed point a known distance from the device 21 detected by the equipment 17/18 at the front of the train.

I claim:

1. A system for computing length of a railway vehicle or a train of such vehicles, said vehicle or train having a front and a rear, comprising:

(a) computing means located on the vehicle or train;

(b) distance measuring means located on the vehicle or train, said distance measuring means being coupled with said computing means for supplying thereto information dependent on distance trav eled by the vehicle or train;

(c) first detecting means, for detecting the passage of the front of the vehicle or train past a first fixed point and transmitting a first indication to said computing means in response to detecting the passage of the front of the vehicle or train past said first fixed point; and (d) second detecting means, for detecting the passage of the rear of the vehicle or train past said first fixed point or a second fixed point a known distance therefrom and transmitting a second indication to said computing means in response to detecting the passage of the rear of the vehicle or train past said first fixed point or said second fixed point;

said computing means for computing a measure of the length of said vehicle or train based on distance travelled by the vehicle or train between reception by the computing means of said first and second indications.

2. A system as claimed in claim 1, in which the computing means also reports a location of the vehicle or train rear based on knowledge of a location of the front.

3. A system as claimed in claim 1, in which the computing means also reports vehicle or train length to a signalling control system so that the signalling control system can subsequently dedcue a location of the vehicle or train rear from reports of a location of the front.

4. A system for computing length of a railway vehicle or a train of such vehicles, said vehicle or train having a front and a rear, comprising;

(a) computing means located on the vehicle or train;

(b) distance measuring means located on the vehicle or train, said distance measuring means being coupled with said computing means for supplying thereto information dependent on distance travelled by the vehicle or train;

(c) first detecting means, for detecting the passage of the front of the vehicle or train past a first fixed point and transmitting a first indication to said computing means in response to detecting the passage of the front of the vehicle or train past said first fixed point, said first detecting means comprising means at the front of the vehicle or train for detecting trackside means at said first fixed point and transmitting said first indication to said computing means in response to detecting said trackside means; and (d) second detecting means at trackside, for detecting the passage of the rear of the vehicle or trainpast said first fixed point or a second fixed point a known distance therefrom and transmitting a second indication to said computing means in response to detecting the passage of the rear of the vehicle or train past said first fixed point or said second fixed point, said second detecting means comprising trackside detecting means for the detection of means at the rear of the vehicle or train and radio transmission means for transmitting said second indication to said computing means in response to detection of said means at the rear of the vehicle or train by said trackside detecting means;

said computing means for computing a measure of the length of said vehicle or train based on distance travelled by the vehicle or train between reception by the computing means of said first and second indications.

5. A system as claimed in claim 4, in which the computing means also reports a location of the vehicle or train rear based on knowledge of a location of the front.

6. A system as claimed in claim 4, in which the computing means also reports vehicle or train length to a signalling control system so that the signalling control system can subsequently deduce a location of the vehicle or train rear from reports of a location of the front.

7. A system for computing length of a railway vehicle or a train of such vehicles, said vehicle or train having a front and a rear, comprising:

(a) computing means located on the vehicle or train;

(b) distance measuring means located on the vehicle or train, said distance measuring means being coupled with said computing means for supplying thereto information dependent on distance travelled by the vehicle or trian;

(c) first detecting means, for detecting the passage of the front of the vehicle ore train past a first fixed point and transmitting a first indication to said computing means in response to detecting the passage of the front of the vehicle or trian past said first fixed point, said first detecting means comprising means at the front of the vehicle or train for detecting first trackside means at said first fixed point and transmitting said first indication to said computing means in response to detecting said first trackside means; and (d) second detecting means, for detecting the passage of the rear of the vehicle or train past said first fixed point or a second fixed point a known distance therefrom and transmitting a second indication to said computing means in response to detecting the passage of the rear of the vehicle or train past said first fixed point or said second fixed point, said second detecting means comprising means at the rear of the vehicle or train for detecting said first trackside means or a second trackside means at said second fixed point and training said second indication to said computing means in response o detecting said first trackside means or said second trackside means;

said computing means for computing a measure of the length of said vehicle or train based on distance travelled by the vehicle or train between reception by the computing means of said first and second indications.

8. A system as claimed in claim 7, in which the computing means also reports a location of the vehicle or train rear based on knowledge of a location of the front.

9. A system as claimed in claim 7, in which the computing means also reports vehicle or train length to a signalling control system so that the signalling control system can subsequently deduce a location of the vehicle or train rear from reports from the vehicle or train of a location of the front.

* * * * *